US007721747B2

(12) United States Patent
Habing

(10) Patent No.: US 7,721,747 B2
(45) Date of Patent: May 25, 2010

(54) COVERED PLAY APPARATUS

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 107 days.

(21) Appl. No.: 11/933,972

(22) Filed: Nov. 1, 2007

(65) Prior Publication Data

US 2009/0114259 A1 May 7, 2009

(51) Int. Cl.
*E04H 15/30* (2006.01)

(52) U.S. Cl. ..... 135/96; 135/117; 135/151; 135/137; 52/83; 52/63; 5/99.1; 4/498

(58) Field of Classification Search ..... 135/87, 135/96, 116, 117, 137, 143–144, 147, 151, 135/905; 5/99.1, 656, 657; 52/63, 66, 83, 52/86, 641; 4/494, 498, 503
See application file for complete search history.

(56) References Cited

U.S. PATENT DOCUMENTS

| | | | | | |
|---|---|---|---|---|---|
| 356,015 | A | * | 1/1887 | Steinberg | 135/154 |
| 1,744,079 | A | | 1/1930 | Phillips | |
| 1,748,932 | A | | 2/1930 | Medart et al. | |
| 2,199,915 | A | | 5/1940 | Howard | |
| D130,746 | S | * | 12/1941 | Oermann | D21/816 |
| 2,673,086 | A | | 3/1954 | Brown, Sr. | |
| 2,724,123 | A | | 1/1955 | Kesler | |
| 2,820,635 | A | | 1/1958 | Herman | |
| 2,841,159 | A | * | 7/1958 | Graham | 135/95 |
| 2,960,992 | A | * | 11/1960 | Klipfel | 135/136 |
| 3,020,045 | A | | 2/1962 | Moss | |
| RE26,140 | E | * | 1/1967 | Schoenike | 135/148 |
| 3,404,915 | A | * | 10/1968 | Filho | 297/17 |
| 3,854,149 | A | * | 12/1974 | Mischke | 4/494 |
| 4,099,344 | A | * | 7/1978 | Ruemeli | 47/19.1 |
| 4,136,408 | A | * | 1/1979 | Dahlbeck et al. | 4/498 |
| 4,343,464 | A | | 8/1982 | Dose | |
| 4,515,360 | A | | 5/1985 | Mariol | |
| 4,548,012 | A | * | 10/1985 | Dyer | 52/646 |
| 5,088,514 | A | * | 2/1992 | House et al. | 135/139 |
| 6,212,702 | B1 | * | 4/2001 | Sitzmann | 4/498 |
| 6,331,147 | B1 | | 12/2001 | Munro et al. | |
| 6,357,462 | B1 | * | 3/2002 | Laosunthara et al. | 135/96 |
| 7,357,440 | B1 | * | 4/2008 | Calandruccio | 296/156 |
| 7,480,946 | B1 | * | 1/2009 | Brown | 4/498 |

* cited by examiner

*Primary Examiner*—Winnie Yip
(74) *Attorney, Agent, or Firm*—Blakely, Sokoloff, Taylor & Zafman LLP

(57) ABSTRACT

A cover assembly for a play area, such as a sandbox, comprises a frame disposed over the play area and a covering material attached to the frame. The frame is constructed so as to be convertible between a first configuration in which children can enter and play in a fully enclosed play area and a second configuration in which the play area is shaded, but open to the outside.

9 Claims, 11 Drawing Sheets

COVERED PLAY APPARATUS

BACKGROUND OF THE INVENTION

1. Field of the Invention

This invention relates generally to the field of children's play apparatus and, more particularly, to a combination cover and enclosure for a sandbox or other play area.

2. Background

Sandboxes are widely popular as a category of children's play apparatus. When not in use, it is desirable to protect the sand in a sandbox from the elements. This helps maintain the sand in good condition for play and helps prevent the sand from being contaminated with foreign objects or substances. Therefore, many sandboxes are provided with removable covers. Many of the prior art sandbox covers are cumbersome to handle and store. Moreover, the prior art sandbox covers are not useful for providing an enclosed play environment.

SUMMARY OF THE INVENTION

The present invention provides a cover assembly for a play area, such as a sandbox, comprising a frame disposed over the play area and a covering material attached to the frame. The frame is constructed so as to be convertible between a first configuration in which the play area may be fully enclosed, yet still be accessible for play, and a second configuration in which the play area is shaded, but open to the outside.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
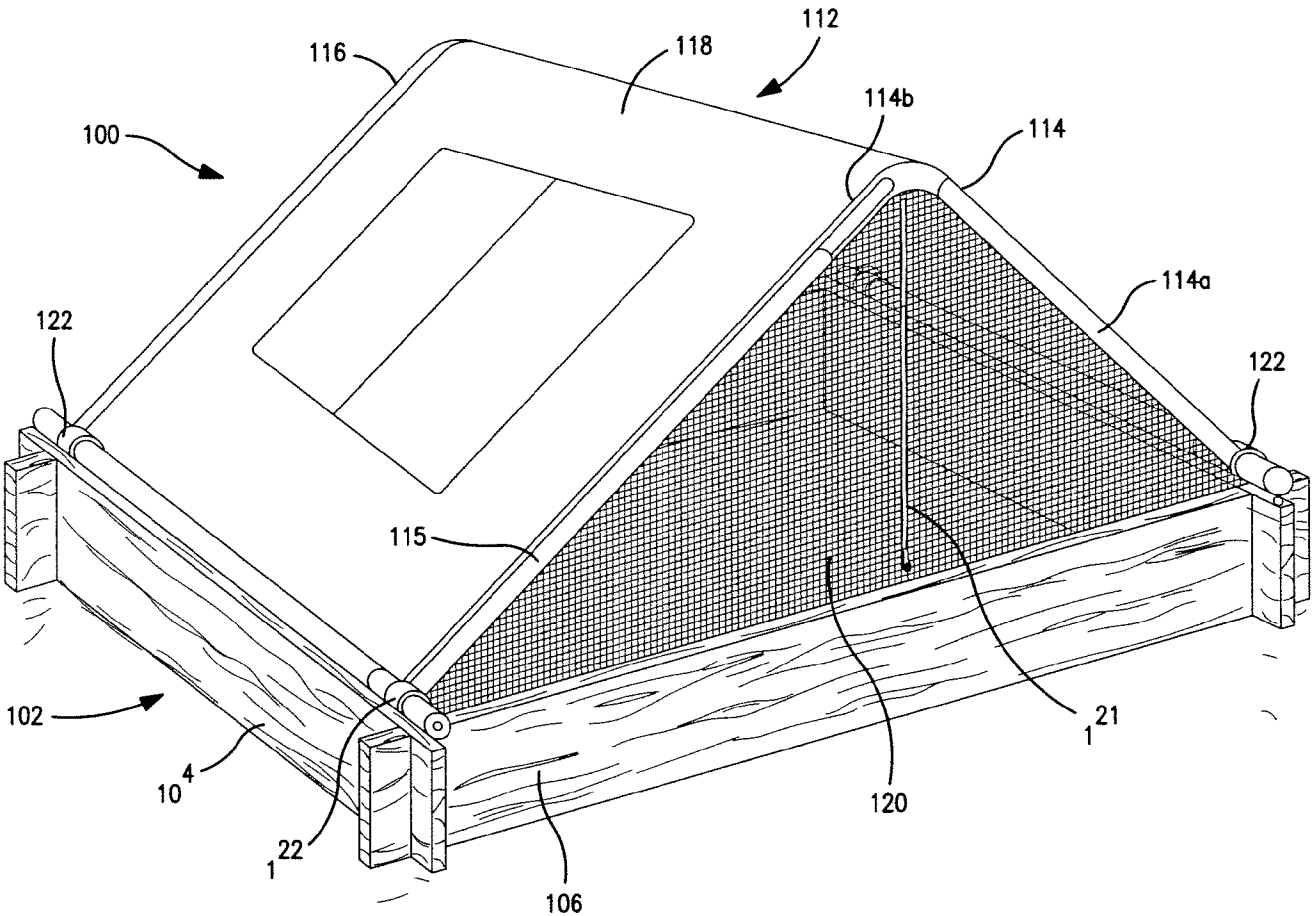
FIG. 1 illustrates a covered play apparatus in a closed configuration in accordance with a first embodiment of the invention.

FIG. 1 shows a first embodiment of a covered play apparatus 100 in which the covered play area comprises a sandbox. Sandbox 102 is formed with perimeter wall members 104, 106, 108 and 110. The perimeter wall members may be made of wood, plastic or other suitable material. A tent-like cover assembly 112 encloses sandbox 102 and protects it from the elements. The cover assembly also prevents intrusion by cats and other animals. The cover assembly comprises a pair of support members 114, 116. Support members 114 and 116 comprise first leg members 114*a* and 116*a*, respectively, and second leg members 114*b* and 116*b*, respectively. In the closed configuration of the cover assembly shown in FIG. 1, each of the support members resembles an inverted letter "V" arcing over a respective side of the sandbox. In alternate embodiments, such as described below, the support members may be curved to resemble an inverted letter "U".

Cover assembly 112 further comprises a covering material 118 attached to support members 114 and 116. Covering material 118 is preferably a waterproof material that will protect the contents of sandbox 102. Material commonly used for camping tents, such as canvas, nylon and the like, are suitable for use as covering material 118. The covering material may be imprinted with decorative designs, such as paw prints, fossils, insects or animals, to provide a themed play apparatus.

Cover assembly 112 further comprises a panel 120 of material attached to support member 114. A corresponding panel of material may also be attached to support member 116. Panel 120 (and the corresponding unseen panel) may be constructed of the same material as covering material 118. Preferably, however, these panels are made of a screen-like material for ventilation, which helps prevent mold and dry out any damp sand. The screened panels also allow sandbox 102 to be used in inclement weather. The panels preferably include an opening 121 to allow for ingress and egress. The opening may be closed with a zipper, Velcro or other suitable means.

Figure 2:
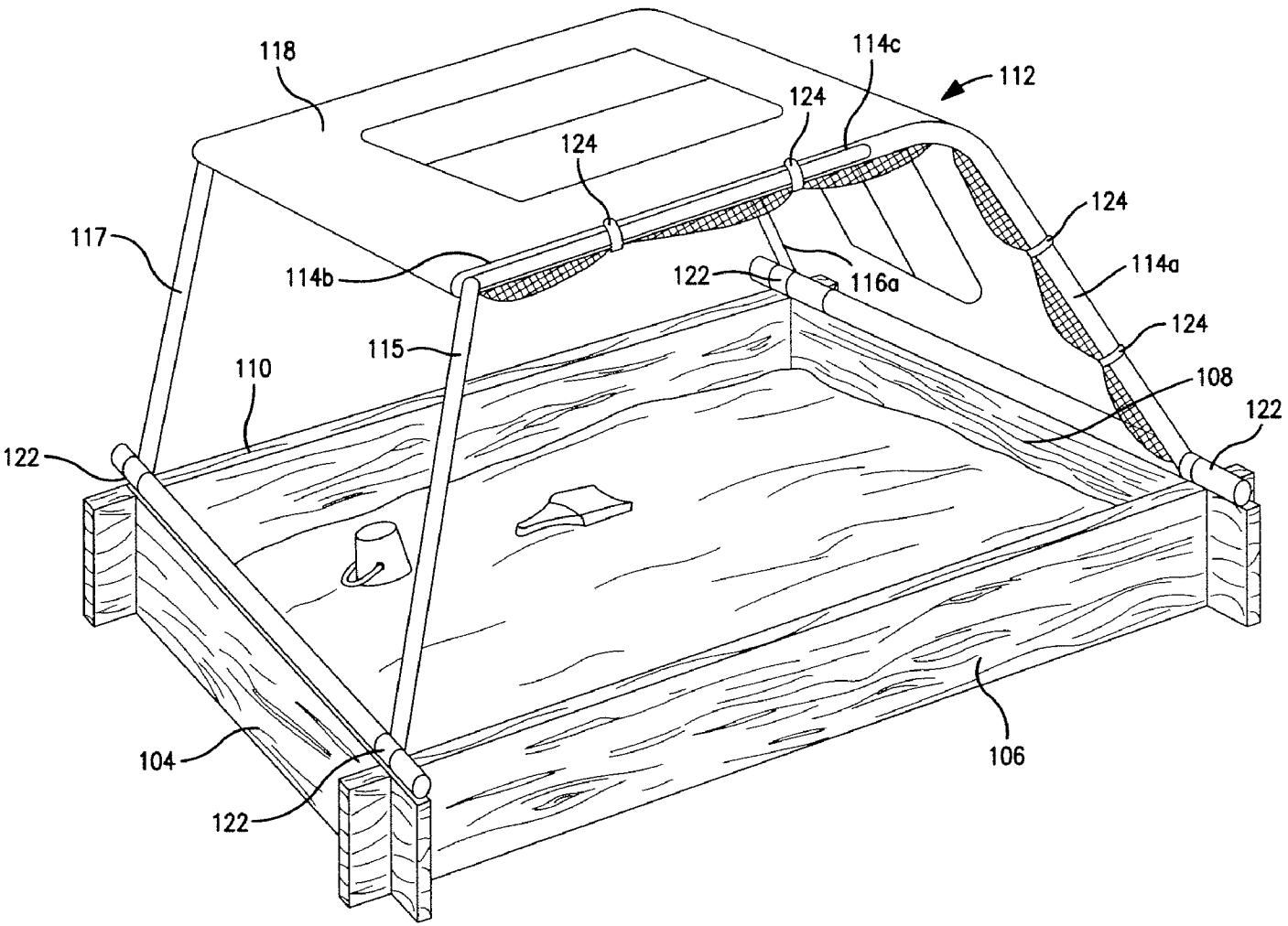
FIG. 2 illustrates the covered play apparatus of FIG. 1 in an open configuration.

Referring now to FIG. 2, cover assembly 112 is shown in an open configuration. Support members 114 and 116 pivot upwards on pivots 122, which are attached to wall member 108. A pair of support struts 115 and 117 are pivotally attached to wall member 104 and are slidingly coupled to respective second leg members in slots 114*c* and 116*c*, respectively. As the support members are pivoted upwardly, the support struts 115 and 117 also pivot upwardly until reaching the ends of the respective slots, at which point the support struts lock into position to secure the support members in the open configuration. In this configuration, each of the support members resembles and inverted letter "L". Covering material 118 remains attached to support members 114 and 116 in the open configuration, thereby providing shade for sandbox 102. If desired, however, the covering material may be detached from the support members and stowed along wall member 108. In the open configuration, the side panels may be furled and secured along their respective support members using straps 124 or other suitable means.

Figure 3:
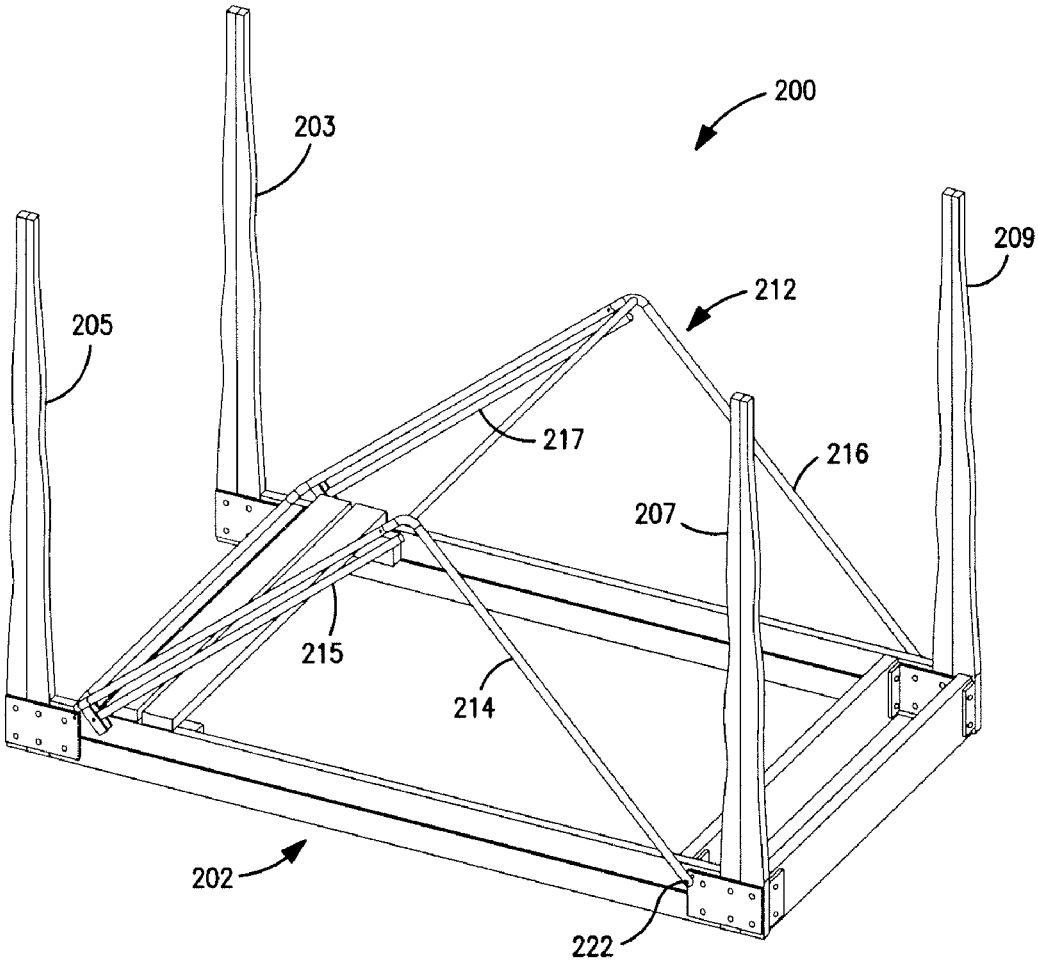
FIG. 3 illustrates a covered play apparatus in a closed configuration in accordance with a second embodiment of the invention.
Figure 4:
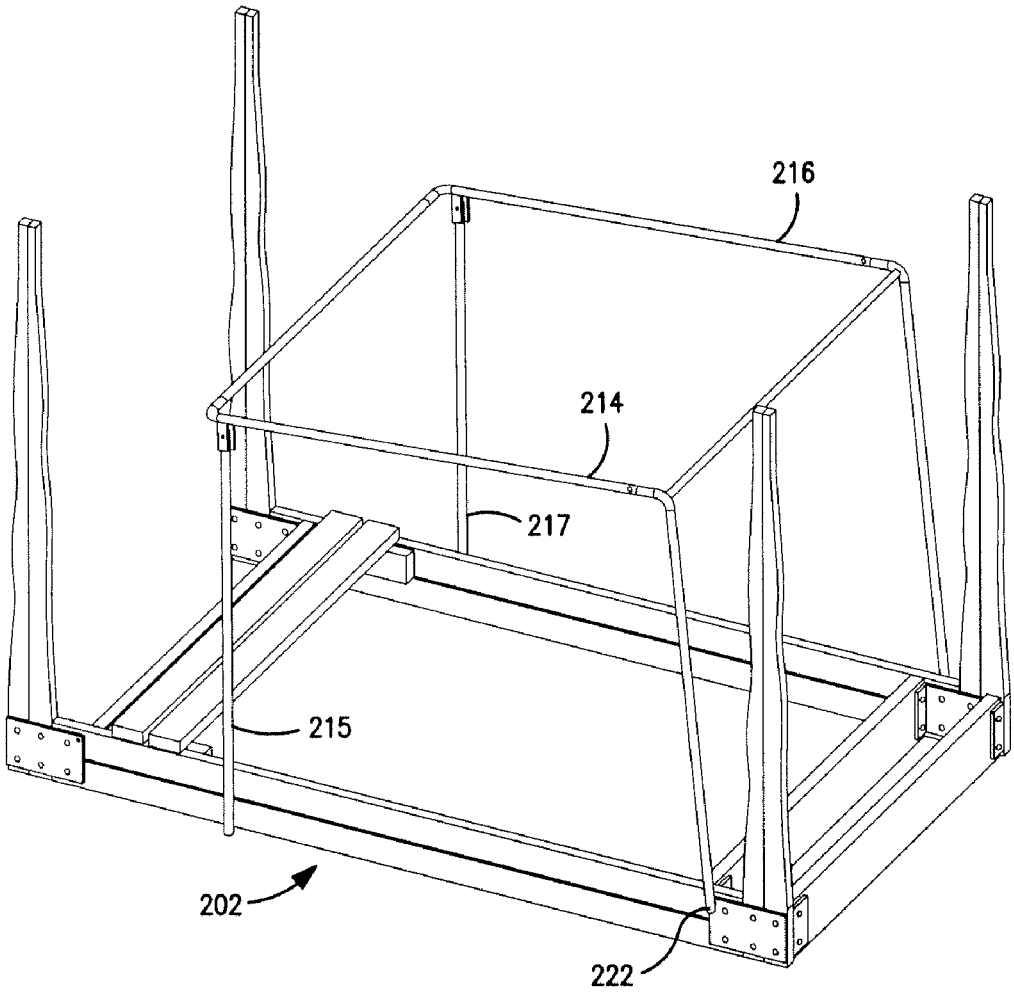
FIG. 4 illustrates the covered play apparatus of FIG. 3 in an open configuration.

FIGS. 3 and 4 illustrate a second embodiment of a covered play apparatus 200 that is generally similar in concept to the embodiment previously described. The covering material and side panels have been omitted for clarity; however, it will be understood that these elements of the previously described embodiment are equally applicable to the embodiment illustrated here. Apparatus 200 comprises sandbox 202 and cover assembly 212. Sandbox 202 includes uprights 203, 205, 207 and 209. The uprights are primarily for decorative effect and contribute to the themed nature of the play apparatus when a decorated covering material is used as described above.

Support members 214 and 216 of the cover assembly 212 are pivotally attached to sandbox 202 at pivots 222. In contrast to the previously described embodiment, support struts 215 and 217 are pivotally connected to support members 214 and 216, respectively, but are not otherwise attached to sandbox 202. To place the cover assembly in its open configuration, the assembly is pivoted up at pivots 222 and the support struts 215 and 217 are pivoted down to rest on the ground.

Figure 5:
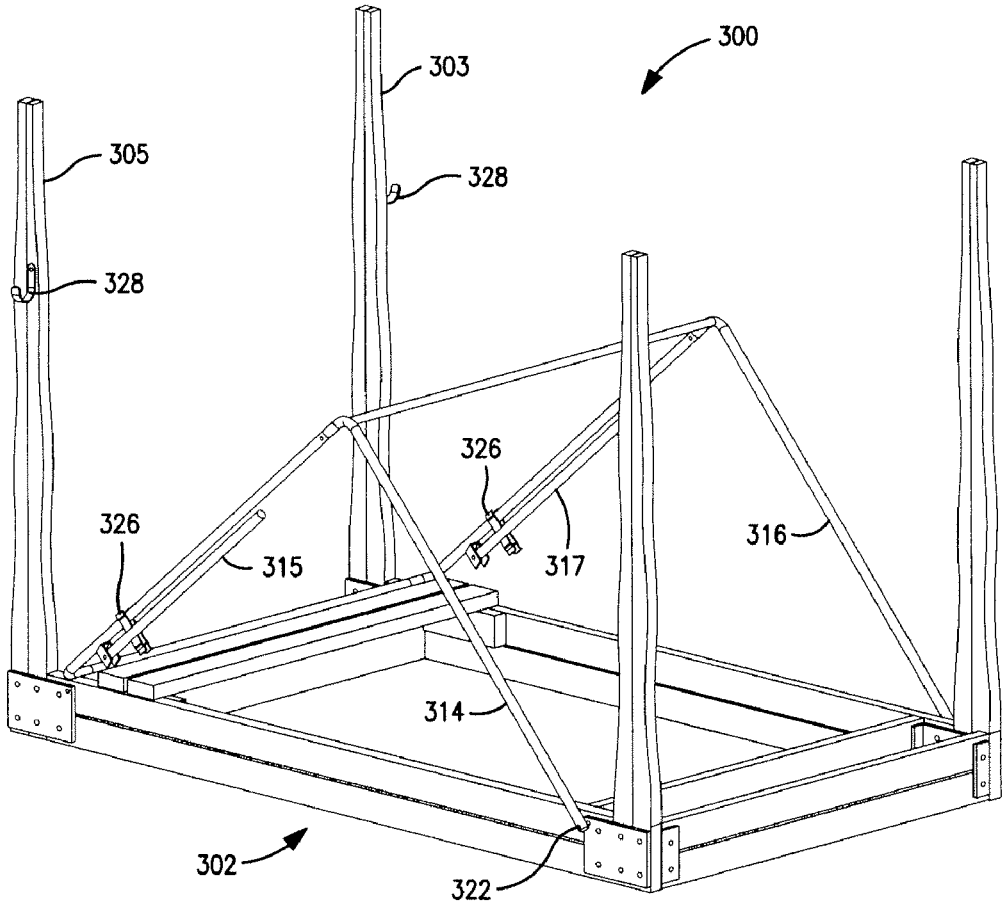
FIG. 5 illustrates a covered play apparatus in a closed configuration in accordance with a third embodiment of the invention.
Figure 6:
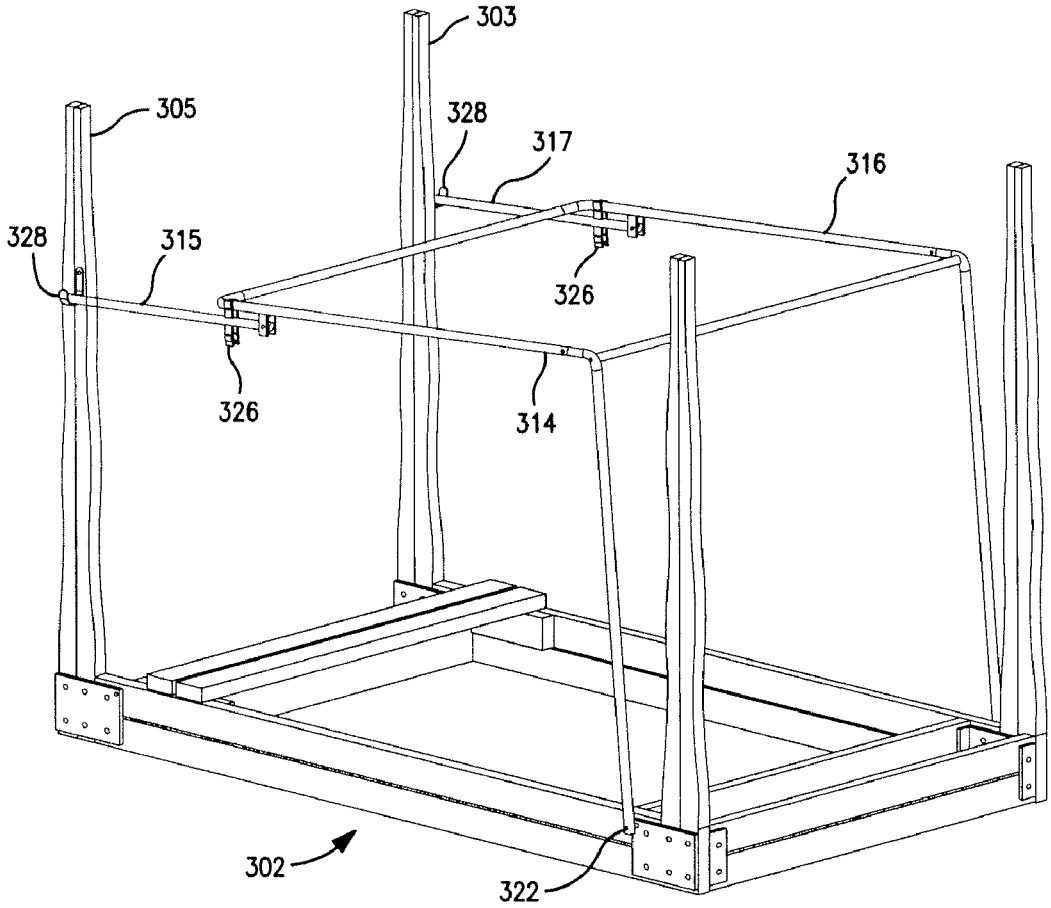
FIG. 6 illustrates the covered play apparatus of FIG. 5 in an open configuration.

FIGS. 5 and 6 illustrate a third embodiment of a play apparatus 300 that is generally similar in concept to the two embodiments previously described. Support members 314 and 316 of the cover assembly are pivotally attached to sandbox 302 at pivots 322 in identical fashion to the second embodiment described immediately above. Support struts 315 and 317 are pivotally connected to support members 314 and 316, respectively, and are fitted with clips 326. These clips keep the support struts aligned with the respective support members while in the closed configuration.

To place the cover assembly in its open configuration, the assembly is pivoted up at pivots 322 and the support struts are unclipped from their respective support members and are rotated approximately 180° to clip to the support members on the opposite side of clips 326. Uprights 303 and 305 each have a hook 328 to hold support struts 315 and 317 when the cover assembly is in its open configuration.

Figure 7:
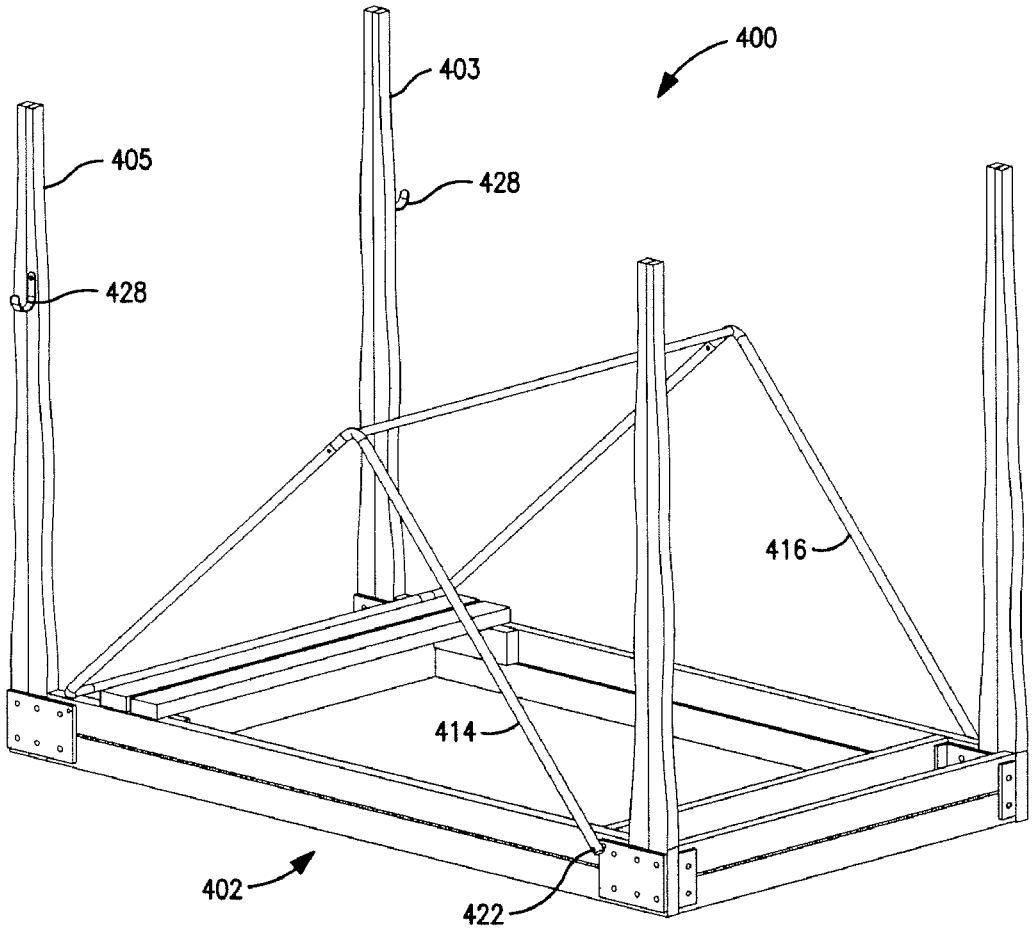
FIG. 7 illustrates a covered play apparatus in a closed configuration in accordance with a fourth embodiment of the invention.
Figure 8:
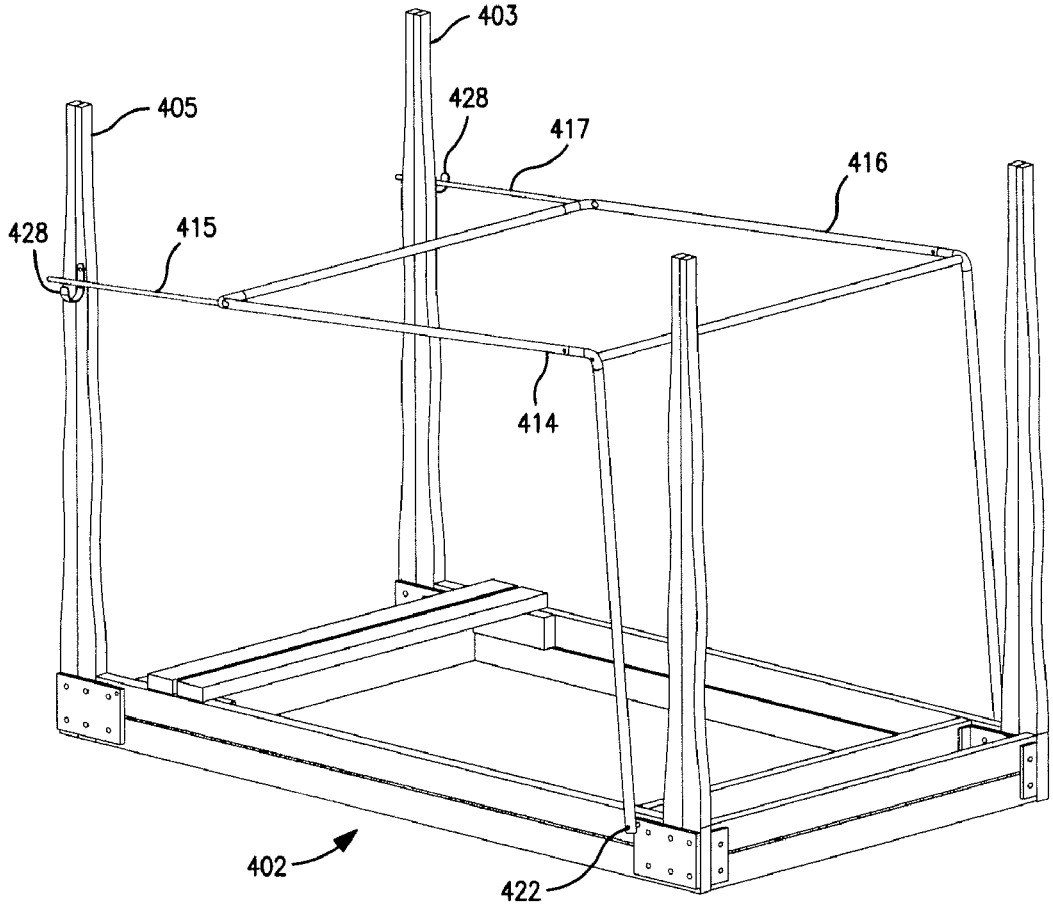
FIG. 8 illustrates the covered play apparatus of FIG. 7 in an open configuration.

FIGS. 7 and 8 illustrate a fourth embodiment of a covered play apparatus 400 that is again generally similar in concept to the embodiments previously described. In this embodiment, support struts 415 and 417 telescope within second leg members 414*b* and 416*b*, respectively. In all other respects, apparatus 400 is identical to apparatus 300 described immediately above. To place the cover assembly in its open configuration, support struts 415 and 417 are slid outwardly from the respective second leg members to rest within hooks 428 on uprights 403 and 405.

Figure 9:
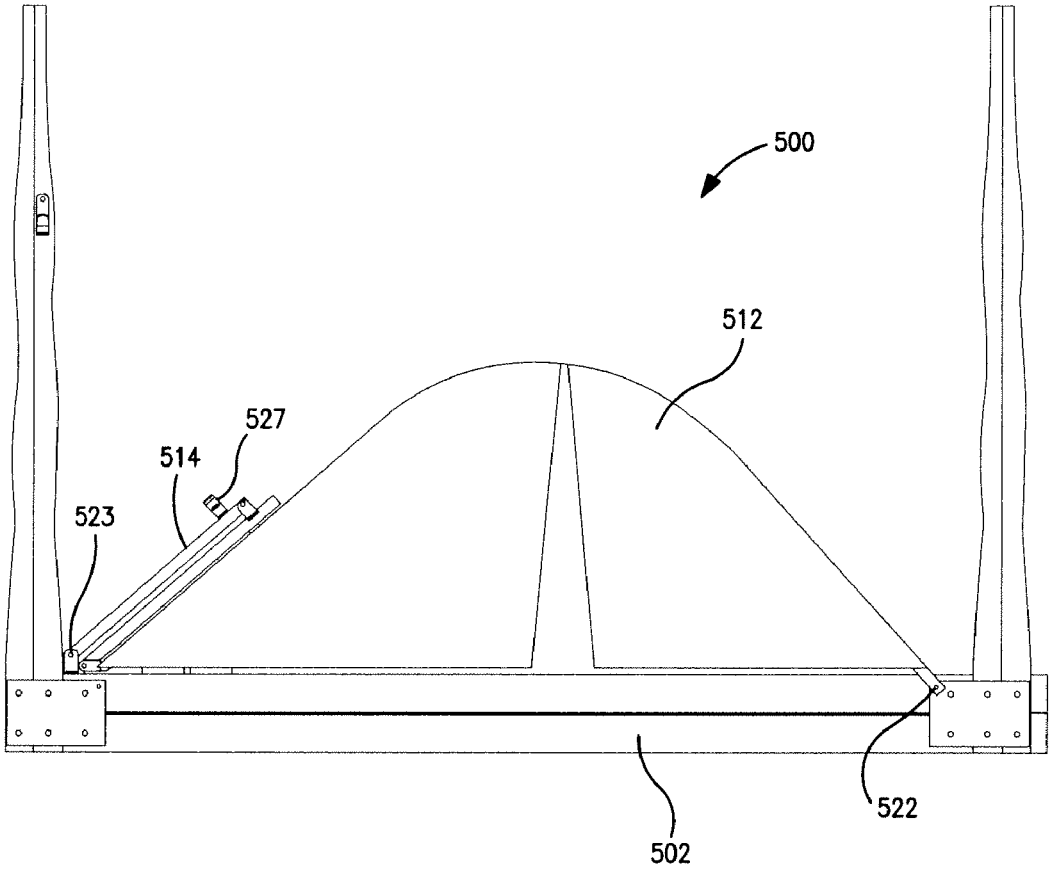
FIG. 9 illustrates a covered play apparatus in a closed configuration in accordance with a fifth embodiment of the invention.
Figure 10:
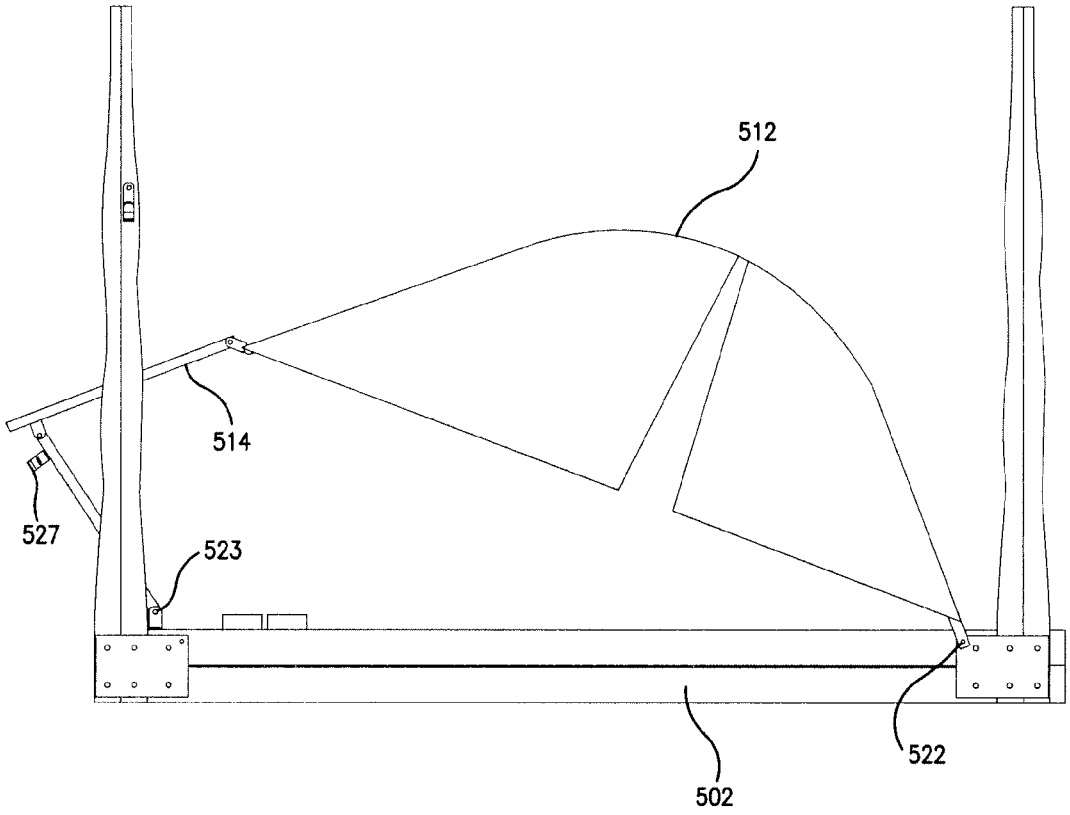
FIG. 10 illustrates the covered play apparatus of FIG. 9 in an intermediate configuration.
Figure 11:
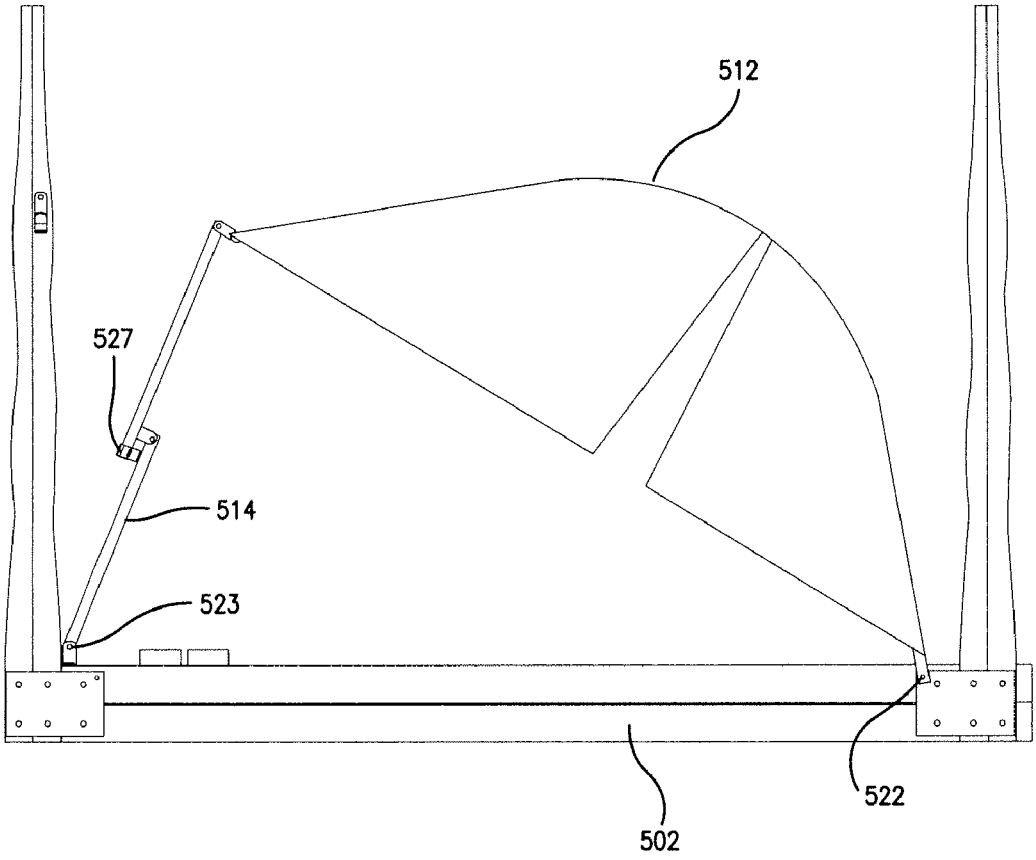
FIG. 11 illustrates the covered play apparatus of FIG. 9 in an open configuration.

FIGS. 9-11 illustrate a fifth embodiment of a covered play apparatus 500. Cover assembly 512 is pivotally coupled to sandbox 502 at pivots 522 in the same manner as the previously described embodiments. In this embodiment, the cover assembly comprises curved support members, each of which generally resembles an inverted letter "U". Cover assembly 512 is supported in the open configuration by articulated support members 514 and 516 (not shown), which are pivotally coupled to sandbox 502 at 523. A clip 527 is attached to support member 514 (and similarly to corresponding support member 516) to lock the support member securely in the open configuration.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A covered play apparatus comprising:

a play area defined by a perimeter structure;

a frame having a pair of support members, each support member having first and second leg members joined at respective first ends, each of the first leg members having a pivot at respective second ends, said pivot attached to the perimeter structure;

first and second support struts pivotally coupled to respective ones of the second leg members;

a covering material attached to and extending between the support members;

wherein the frame is pivotally positionable between a first and a second configuration, the first configuration characterized by the support members extending above the perimeter structure and oriented concave downward with respective second ends of the second leg members resting on the perimeter structure such that the support members resemble one of an inverted letter "V" and an inverted letter "U", and the second configuration characterized by the first leg members being inclined more vertical than in the first configuration and the first and second support struts supporting the second leg members above the perimeter structure.

2. The covered play apparatus of claim 1 further comprising a pair of closure panels attached to respective ones of the support members.

3. A covered play apparatus comprising:

a play area defined by a perimeter structure;

a frame having a pair of support members, each support member having first and second leg members joined at respective first ends, each of the first leg members having a pivot at respective second ends, said pivot attached to the perimeter structure;

a covering material attached to and extending between the support members;

first and second uprights attached to the perimeter structure and spaced apart from respective ones of the pivots;

wherein the frame is pivotally positionable between a first and a second configuration, the first configuration characterized by the support members extending above the perimeter structure and oriented concave downward with respective second ends of the second leg members resting on the perimeter structure such that the support members resemble one of an inverted letter "V" and an inverted letter "U", and the second configuration characterized by the support members being supported by the uprights with the second leg members supported above the perimeter structure and the first leg members being inclined more vertical than in the first configuration.

4. The covered play apparatus of claim 3 further comprising first and second support struts coupled to respective ones of the second leg members.

5. The covered play apparatus of claim 4 wherein the support struts are supported by the uprights in the second configuration.

6. The covered play apparatus of claim 5 wherein the support struts are pivotally coupled to respective ones of the second leg members.

7. The covered play apparatus of claim 5 wherein the support struts are telescopically coupled to respective ones of the second leg members.

8. The covered play apparatus of claim 7 wherein the support struts are retracted in the first configuration and are extended in the second configuration.

9. The covered play apparatus of claim 3 further comprising a pair of closure panels attached to respective ones of the support members.

* * * * *